US006716561B2

(12) United States Patent
Shiraishi et al.

(10) Patent No.: US 6,716,561 B2
(45) Date of Patent: Apr. 6, 2004

(54) TONER FOR DEVELOPING ELECTROSTATIC LATENT IMAGE AND IMAGE FORMING METHOD USING SAME

(75) Inventors: Keiko Shiraishi, Susono (JP); Masanori Suzuki, Sunto-gun (JP); Yohichiroh Watanabe, Fuji (JP); Masahide Yamashita, Numazu (JP); Akihiro Kotsugai, Numazu (JP); Toyoshi Sawada, Odawara (JP); Kohki Katoh, Sunto-gun (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/993,606

(22) Filed: Nov. 27, 2001

(65) Prior Publication Data

US 2002/0136975 A1 Sep. 26, 2002

(30) Foreign Application Priority Data

Nov. 28, 2000 (JP) ..... 2000-361593

(51) Int. Cl.[7] ..... G03G 9/087

(52) U.S. Cl. ..... 430/110.1; 430/109.1; 430/109.3; 430/109.4; 430/108.22; 430/108.4; 430/114.4; 430/124; 430/108.8; 399/329

(58) Field of Search ..... 430/110.1, 109.4, 430/109.1, 108.8, 124, 108.4, 111.4, 108.22, 109.3; 399/329

(56) References Cited

U.S. PATENT DOCUMENTS

| | | | | | |
|---|---|---|---|---|---|
| 3,974,078 | A | * | 8/1976 | Crystal | 430/110.1 |
| 4,713,310 | A | * | 12/1987 | Horie | 430/110.1 |
| 4,762,763 | A | | 8/1988 | Nomura et al. | |
| 4,908,290 | A | | 3/1990 | Watanabe et al. | |
| 4,933,250 | A | | 6/1990 | Nakayama et al. | |
| 4,950,573 | A | | 8/1990 | Yamaguchi et al. | |
| 4,956,258 | A | | 9/1990 | Watanabe et al. | |
| 4,980,258 | A | | 12/1990 | Aoki et al. | |
| 5,168,028 | A | | 12/1992 | Nanya et al. | |
| 5,288,577 | A | | 2/1994 | Yamaguchi et al. | |
| 5,318,871 | A | * | 6/1994 | Inagaki et al. | 430/110.1 |
| 5,344,732 | A | | 9/1994 | Chiba et al. | |
| 5,368,972 | A | | 11/1994 | Yamashita et al. | |
| 5,380,616 | A | * | 1/1995 | Aoki et al. | 430/110.1 |
| 5,403,690 | A | | 4/1995 | Kuramoto et al. | |
| 5,429,901 | A | | 7/1995 | Muto et al. | |
| 5,554,478 | A | | 9/1996 | Kuramoto et al. | |
| 5,655,199 | A | | 8/1997 | Yamashita et al. | |
| 5,721,083 | A | | 2/1998 | Masuda et al. | |
| 5,774,775 | A | | 6/1998 | Aoto et al. | |
| 5,840,456 | A | | 11/1998 | Tomita et al. | |
| 5,863,690 | A | | 1/1999 | Yamashita | |
| 5,873,018 | A | | 2/1999 | Aoto et al. | |
| 5,882,832 | A | | 3/1999 | Tosaka et al. | |
| 5,912,100 | A | | 6/1999 | Aoki et al. | |
| 6,004,715 | A | | 12/1999 | Suzuki et al. | |
| 6,010,814 | A | | 1/2000 | Kotsugai et al. | |
| 6,074,794 | A | | 6/2000 | Fushimi et al. | |
| 6,074,795 | A | | 6/2000 | Watanabe et al. | |
| 6,103,441 | A | | 8/2000 | Tomita et al. | |
| 6,168,894 | B1 | | 1/2001 | Aoki et al. | |
| 6,180,298 | B1 | | 1/2001 | Kuroda et al. | |
| 6,183,926 | B1 | | 2/2001 | Kuroda et al. | |
| 6,212,351 | B1 | | 4/2001 | Kawagoe et al. | |
| 6,221,549 | B1 | | 4/2001 | Emoto et al. | |
| 6,228,550 | B1 | | 5/2001 | Matsuda et al. | |
| 6,243,559 | B1 | * | 6/2001 | Kurotaka et al. | 399/329 |
| 6,258,502 | B1 | | 7/2001 | Nakamura et al. | |
| 6,269,228 | B1 | | 7/2001 | Kayahara et al. | |
| 6,303,257 | B1 | | 10/2001 | Hasegawa et al. | |
| 6,303,258 | B1 | | 10/2001 | Katoh et al. | |
| 6,335,137 | B1 | | 1/2002 | Suzuki et al. | |
| 6,360,068 | B1 | | 3/2002 | Kinoshita et al. | |
| 6,363,229 | B1 | | 3/2002 | Shiraishi et al. | |
| 6,395,443 | B2 | | 5/2002 | Kuroda et al. | |
| 6,405,002 | B2 | | 6/2002 | Ogiyama et al. | |
| 6,406,826 | B1 | | 6/2002 | Suzuki et al. | |
| 6,432,589 | B1 | | 8/2002 | Uchinokura et al. | |
| 6,445,900 | B2 | | 9/2002 | Fukao et al. | |
| 6,449,453 | B1 | | 9/2002 | Motohashi | |
| 6,505,014 | B2 | | 1/2003 | Aoki et al. | |
| 6,505,024 | B2 | | 1/2003 | Kayahara et al. | |
| 2002/0018676 | A1 | * | 2/2002 | Hirai et al. | 399/329 |
| 2002/0037467 | A1 | * | 3/2002 | Watanabe et al. | 430/110.1 |
| 2002/0061456 | A1 | * | 5/2002 | Takezawa et al. | 430/110.1 |

FOREIGN PATENT DOCUMENTS

| | | |
|---|---|---|
| JP | 5-188636 | 7/1993 |
| JP | 6-250432 | 9/1994 |
| JP | 7-84407 | 3/1995 |
| JP | 8-101526 | 4/1996 |
| JP | 9-127718 | 5/1997 |
| JP | 10-207116 | 8/1998 |

OTHER PUBLICATIONS

U.S. patent application Ser. No. 09/988,142, filed Nov. 19, 2001, pending.
U.S. patent application Ser. No. 10/091,498, filed Mar. 7, 2002, pending.
U.S. patent application Ser. No. 09/826,789, filed Apr. 5, 2001, unknown.
U.S. patent application Ser. No. 09/910,080, filed Jul. 23, 2001, allowed.
U.S. patent application Ser. No. 09/943,505, filed Aug. 31, 2001, pending.

(List continued on next page.)

*Primary Examiner*—Christopher Rodee
(74) *Attorney, Agent, or Firm*—Oblon, Spivak, McClelland, Maier & Neustadt, P.C.

(57) ABSTRACT

A toner for developing electrostatic latent images, including a matrix of a first resin selected from polyester resins, polyol resins and mixtures thereof, a plurality of domains of a second resin dispersed in the matrix and containing a wax. The amount of the wax is 2–15% by weight based on the weight of the toner The matrix is substantially free of domains of the second resin having a maximum diameter of greater than 2.0 $\mu$m. A part of the domains containing the wax having a maximum diameter of at least 0.2 $\mu$m constitutes a part of an outer surface of the toner.

14 Claims, 1 Drawing Sheet

OTHER PUBLICATIONS

U.S. patent application Ser. No. 09/945,839, filed Sep. 5, 2001, pending.
U.S. patent application Ser. No. 09/948,576, filed Sep. 10, 2001, pending.
U.S. patent application Ser. No. 09/963,644, filed Sep. 27, 2001, pending.
U.S. patent application Ser. No. 09/984,236, filed Oct. 29, 2001, pending.
U.S. patent application Ser. No. 09/983,687, filed Oct. 25, 2001, pending.
U.S. patent application Ser. No. 09/987,027, filed Nov. 13, 2001, allowed.
U.S. patent application Ser. No. 10/041,582, filed Jan. 10, 2002, pending.
U.S. patent application Ser. No. 10/050,959, filed Jan. 22, 2002, pending.
U.S. patent application Ser. No. 10/050,955, filed Jan. 22, 2002, pending.
U.S. patent application Ser. No. 10/054,993, filed Jan. 25, 2002, pending.
U.S. patent application Ser. No. 10/073,237, filed Feb. 13, 2002, allowed.
U.S. patent application Ser. No. 10/075,402, filed Feb. 15, 2002, pending.
U.S. patent application Ser. No. 10/083,159, filed Feb. 27, 2002, pending.
U.S. patent application Ser. No. 10/107,249, filed Mar. 28, 2002, pending.
U.S. patent application Ser. No. 10/143,928, filed May 14, 2002, pending.
U.S. patent application Ser. No. 09/709,795, filed Nov. 10, 2000, unknown.
U.S. patent application Ser. No. 09/696,959, filed Oct. 27, 2000, allowed.
U.S. patent application Ser. No. 09/947,391, filed Sep. 7, 2001, pending.
U.S. patent application Ser. No. 09/960,922, filed Sep. 25, 2001, pending.
U.S. patent application Ser. No. 10/104,078, filed Mar. 25, 2002, pending.
U.S. patent application Ser. No. 10/151,109, filed May 21, 2002, pending.
U.S. patent application Ser. No. 10/282,039, filed Oct. 29, 2002, pending.
U.S. patent application Ser. No. 10/152,672, filed May 23, 2002, pending.
U.S. patent application Ser. No. 10/268,830, filed Oct. 11, 2002, pending.

* cited by examiner

TONER FOR DEVELOPING ELECTROSTATIC LATENT IMAGE AND IMAGE FORMING METHOD USING SAME

BACKGROUND OF THE INVENTION

This invention relates to a toner for developing electrostatic latent image formed by electrophotography, electrostatic recording or electrostatic printing.

With an increasing requirement for energy saving in view of environmental protection, there is an increasing demand for toner capable of being fixed at a low temperature. Thus, the use of a polyester resin as a toner binder in place of a customarily employed styrene-acrylate copolymer is now proposed, because the polyester resin can provide toner permitting relatively low temperature fixation and having relatively good preservability. With a view toward improving the low temperature fixation, proposals have been made to use a polyester having a low glass transition point or a polyester having a low molecular weight. The former technique, however, adversely affects the preservability of the toner at an elevated temperature. The latter technique results in occurrence of hot offset, namely deposition of fused toner onto a heated roll used for fixing a toner image on a transfer medium such as paper.

Hot offset can be prevented by applying an oil to a surface of the heated roll. However, since an oil tank must be installed in the image forming apparatus, compactness of the apparatus is not attainable. Thus, in lieu of applying an oil, incorporation of a wax in toner has been proposed. During fixation, the wax melts and exudes from the toner particles to exhibit its releasing properties. Rather than being homogeneous mixed in the toner binder, therefore, the wax is desired to form a plurality of domains and to be dispersed in the matrix of the binder. As the binder, a resin incompatible with the wax should be preferably used.

In a grinding step for preparing toner particles containing a wax and an incompatible binder resin, stresses are predominantly exerted at interfaces between the wax particles and the binder resin. Therefore, the wax is apt to be present on outer surfaces of the toner particles. Further, the greater the dispersion diameter of the wax particles, the larger becomes the amount of the wax exposed to outer surfaces of the toner particles. While the presence of the wax on outer surfaces of the toner is advantageous from the standpoint of releasability, fluidity of such toner becomes unsatisfactory. Further, a filming problem, namely deposition of the wax onto carrier particles, a photoconductor or a charger is apt to occur.

Polyester resins are less compatible with a wax than styrene-acrylic copolymer resins are. When the polyester resin is of a type which does not require low temperature fixation (e.g. a high softening point polyester), kneading of the polyester resin together with a wax can be carried out with such a high shear force that the wax is finely dispersed in the polyester resin matrix. In this case, even when the wax is excessively finely divided, the polyester resin having a large cohesive force can provide releasability. When the polyester resin is of a type which requires low temperature fixation, however, the kneading cannot be performed in high shear conditions so that the wax is not finely dispersed in the resin. Therefore, the durability and transferability of the resulting toner are adversely affected by the wax.

In the case of a full color toner, the binder resin is required to have a lower softening point as compared with that for a black toner in order to obtain good gloss and good OHP transmissivity. Therefore, the wax of color toner is less easily finely dispersed in the binder resin.

To cope with the above problem, the use of a polystyrene resin to which a styrene resin has been grafted as a dispersing agent has been proposed (JP-A-H08-101526, JP-A-H05-188636, JP-A-H06-250432 and JP-A-H09-127718). While a wax can be finely dispersed in the resin matrix when such a dispersing agent is used, the amount of the wax must be increased in order to attain satisfactory releasability. As a consequence, the durability and transferability of the resulting toner are adversely affected by the wax.

JP-A-H07-084407 and JP-A-H10-207116 propose a toner produced by suspension-polymerizing a composition containing a wax, a polymerizable monomer, a colorant, etc. In such a toner, since the hydrophobic wax is surrounded by the binder resin, it takes a relatively long time for the wax to exude from the toner surfaces. Thus, high speed image formation is adversely affected.

In the case of a full color toner, the toner image must have a proper gloss. Therefore, during the fixation of a toner image, the toner is sufficiently fused to obtain smooth image surfaces. Hitherto, a heat roller is used to fix toner images on an image receiving sheet such as paper. The heat roller-type fixation has problems because a relatively long time is required to heat the roller to a predetermined heating temperature and because the heat roller must have a large heat capacity to maintain the heating temperature. On the other hand, a recently proposed belt-type fixation is free of such problems. Further, since the paper is in contact with a flat portion of the belt, occurrence of offset and curl can be reduced. Additionally, since the heating point and discharge point are spaced apart a sufficient distance to provide an increased fixing time inclusive of preheat time and nip time, the fixation temperature may be reduced without reducing image production speed. However, since the belt should be thin in order to reduce the heat capacity and since the pressure at which the belt is contacted with the paper should be low in order to prevent formation of wrinkles, the belt-type fixation is less advantageous with respect to the formation of images having high gloss.

SUMMARY OF THE INVENTION

It is, therefore, an object of the present invention to provide a toner which has permits low temperature fixation while preventing hot offset.

Another object of the present invention is to provide a toner which has good transferability and high developing efficiency.

It is a further object of the present invention to provide a full color toner capable of giving color images with satisfactory gloss and transparency.

It is yet a further object of the present invention to provide a toner of the above-mentioned type which has good heat resistance and preservability.

It is a further object of the present invention to provide a toner which can be produced with high efficiency, in particular with high pulverization efficiency.

In accomplishing the foregoing object, the present invention provides a toner for developing electrostatic latent images, which includes a matrix of a first resin selected from the group consisting of polyester resins, polyol resins and mixtures thereof, a plurality of domains of a second resin dispersed in said matrix and containing wax in an amount of 2–15% by weight based on the weight of the toner. The matrix is substantially free of domains of the second resin having a maximum diameter of greater than 2.0 μm. A part of the domains containing wax having a maximum diameter of at least 0.2 μm constitutes a part of an outer surface of the toner.

It has been found that, when the toner has a construction as defined above, wax having a proper particle size can be finely dispersed in the first resin matrix while maintaining the amount of the wax exposed on an outer surface of the toner small. Namely, shearing forces exerted during pulverization for forming the toner are predominantly applied to the interface between the first and second resins. Thus, the islands of the second resin are present in a relatively large amount on outer surfaces of the resulting toner particles, while the amount of the wax present on outer surfaces of the toner particles is small. However, the wax is not prevented from exuding from the toner surfaces during fixation because it is present in portions adjacent to or near the outer surfaces of the islands, namely adjacent to or near the outer surfaces of the toner particle.

BRIEF DESCRIPTION OF DRAWINGS

Other objects, features and advantages of the present invention will become apparent from the detailed description of the preferred embodiments of the present invention which follows, when considered in light of the accompanying drawings, in which.

DETAILED DESCRIPTION OF THE PREFERRED EMBODIMENTS OF THE INVENTION

Figure 1:
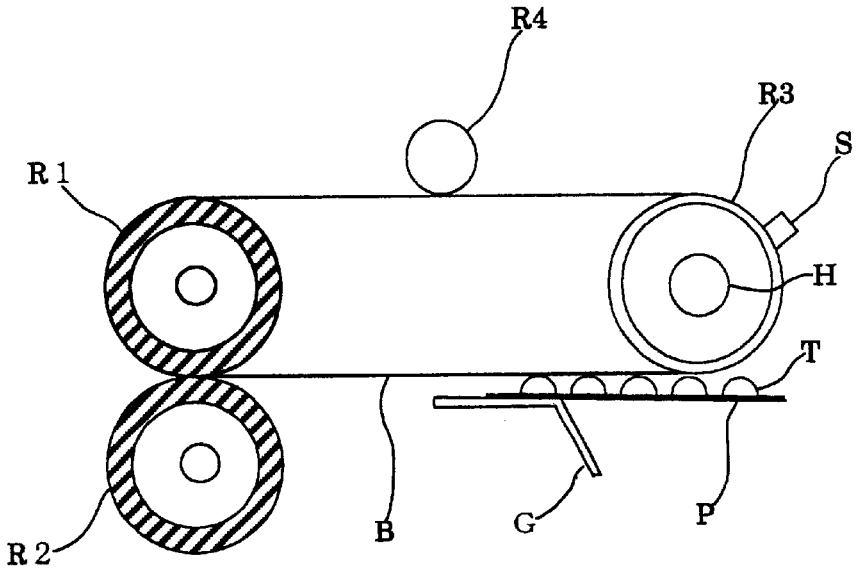
FIG. 1 is a cross-sectional view schematically illustrating a belt-type image fixing device.

A toner according to the present invention includes a first resin of a polyester resin and/or a polyol resin forming a matrix which is like a sea, and a second resin incompatible with the first resin and forming domains which are like islands dispersed in the sea. A wax is contained in the islands.

It is not necessary that all of the wax should be contained in the islands. The dispersion diameters of the wax generally distribute in a relatively wide range. Since extremely small diameter wax particles hardly provide an interface at which pulverization occurs, the presence of such extremely small diameter wax particles outside the islands does not hinder the attainment of the objects of the present invention. Thus, it is preferred that at least 95% by number of the wax particles having a maximum diameter of 0.5 μm or more be contained in the islands. More preferably, all of the wax particles having a maximum diameter of 0.5 μm or more are contained in the islands. Most preferably, all of the wax particles are contained in the islands. The wax preferably has a maximum dispersion diameter of 2 μm or less. It is also preferred that wax have such a particle size distribution that wax particles having a dispersion diameter of 0.1 μm or less be no more than 30% by number based on the all wax particles detectable by TEM observation with a magnification of 10,000.

A part of the islands containing wax particles having a maximum diameter of at least 0.2 μm should be present on an outer surface of the toner to constitute a part of the outer surface of the toner.

When the wax is not exposed to an outer surface of the toner but is present in a portion adjacent to or near the outer surface of the toner, the particle size of the wax can be increased so as to enhance exudation thereof during an image fixation step. Further, as the dispersion diameter of the islands increases, the greater becomes the possibility of existence of the islands on outer surfaces of the toner particles. Namely, when the islands have a relatively large dispersion diameter, pulverization tends to occur with a greater likelihood at interfaces between the islands and the sea rather than at interfaces between the wax and the second resin which forms the islands. Further, there is a greater possibility that islands containing the wax therewithin are present on the outer surfaces of the toner particles than a possibility that the wax particles which are not contained in the islands are present on the outer surfaces of the toner particles. Also, the larger a difference in diameter between the islands and the wax particles, the greater is a possibility that the pulverization occurs at the interfaces between the sea and the islands.

Therefore, it is preferred that at least part of the islands contain the wax having a maximum diameter of 0.5 μm or more and have a dispersion diameter greater than the wax and that a part of such islands be present on an outer surface of the toner to constitute a part of the outer surface of the toner. In this case, the amount of wax particles which are present near the outer surfaces of the toner particles and which are contained inside the islands is increased so that the releasability and transferability of the toner are high while effectively preventing filming problems.

However, when the dispersion diameter of the islands is excessively large, the dispersion diameter of the wax tends to be so large that there is an increased possibility that the pulverization occurs at interfaces between the wax particles and the second resin. Further, the dispersion of a colorant of and transparency of a color image of the resulting toner tend to be adversely affected. Thus, it is desirable that the sea is substantially free of islands of the second resin having a maximum diameter of greater than 2.0 μm. In particular, it is preferred that the amount of the islands having a maximum diameter of greater than 2.0 μm be not more than 1% by number. It is more preferred that the sea is substantially free of islands of the second resin having a maximum diameter of greater than 1.5 μm.

The amount of the wax in the toner is suitably within the range of 2–15% by weight based on the weight of the toner. Too large an amount of the wax in excess of 15% by weight will excessively increase the dispersion diameter of the wax or excessively increase the number of the wax particles. Thus, even when such wax particles are contained in the islands, the wax may present on the outer surfaces of the toner. An amount of the wax below 2% by weight is insufficient to impart satisfactory releasability to the toner.

Any wax may be suitably used for the purpose of the present invention. Examples of such waxes include low molecular weight polyolefin wax such as low molecular weight polyethylene wax and low molecular weight polypropylene wax; synthetic hydrocarbon wax such as Fischer-Tropsh wax; natural wax such as carnauba wax, candelilla wax, rice wax, montan wax; petroleum waxe such as paraffin wax and microcrystalline wax; higher fatty acids such as stearic acid, palmitic acid and millystyric acid; metal salts or amides of higher fatty acids; and modified waxes of the above waxes. These waxes may be used singly or in combination of two or more thereof. It is preferred that the wax have a melting point in the range of 70–125° C. for reasons of satisfactory transferability, duration and releasability.

The first resin which forms the sea or matrix of the toner of the present invention is a polyester resin and/or a polyol resin.

Any polyester may be used for the purpose of the present invention. Polyesters may be obtained by polycondensation of a polyol and a polyacid. The polyol may be a diol or a tri- or more polyhydric alcohol. As the diol to be used for the preparation of the polyester, any diol employed conventionally for the preparation of polyester resins can be employed. Preferred examples include alkylene glycols having 2 to 12 carbon atoms, such as ethylene glycol, 1,2-propylene glycol, 1,3-propylene glycol, 1,4-butane diol, neopentyl glycol, 1,4-butene diol, 1,5-pentane diol, and 1,6-hexane diol; alkylene ether glycols, such as diethylene glycol, triethylene glycol, dipropylene glycol, polyethylene glycol, polypropylene glycol, and polytetramethylene glycol; alicyclic diols having 6 to 30 carbon atoms, such as 1,4-cyclohexane dimethanol and hydrogenated bisphenol A; bisphenols, such as bisphenol A, bisphenol F and bispbenol S; adducts of the above-mentioned bisphenol with 2 to 8 moles of an alkylene oxide, such as ethylene oxide, propylene oxide, or butylene oxide.

Examples of the polyol having three or more hydroxyl groups include polyhydric aliphatic alcohols having 3 to carbon atoms, such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylolethane, and trimethylolpropane.

The polyacid may be a dicarboxylic acid, tri- or more polybasic carboxylic acid or a mixture thereof. As the dicarboxylic acid to be used for the preparation of the base polyester, any dicarboxylic acid conventionally used for the preparation of a polyester resin can be employed. Preferred examples of dicarboxylic acids include maleic acid, fumaric acid, succinic acid, adipic acid, sebacic acid, malonic acid, azelaic acid, mesaconic acid, citraconic acid, glutaconic acid, cyclohexanedicarboxylic acid, phthalic acid, isophthalic acid, terephthalic acid, toluenedicarboxylic acid, naphthalenedicarboxylic acid, succinic acid, adipic acid, sebacic acid, malonic acid, lower alkyl esters thereof, and anhydrides thereof. These dicarboxylic acids may have one or more saturated or unsaturated hydrocarbyl groups having 3–22 carbon atoms.

Specific examples of the polycarboxylic acid having three or more carboxyl groups include 1,2,4-benzenetricarboxylic acid, 1,2,5-benzenetricarboxylic acid, 2,5-7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Enbol trimer acid, linoleic acid dimer, anhydrides thereof and lower alkyl esters thereof.

If desired, an aliphatic monocarboxylic acid such as octanoic acid, decanoic acid, dodecanoic acid, myristic acid, palmitic acid and stearic acid or an aliphatic monoalcohol such as octanol, decanol, dodecanol, myristyl alcohol, palmityl alcohol and stearyl alcohol may be used to prepare polyester resins.

Any polyol resin may be used as the first resin. Illustrative of suitable polyol resins are those obtained by reaction of the following compounds: (1) an epoxy resin, (2) an alkylene oxide adduct of a dihydric phenol or a glycidyl ether of the alkylene oxide adduct; (3) a compound having in the molecule thereof one active hydrogen atom which is capable of reacting with epoxy group; and (4) a compound having in the molecule thereof two or more active hydrogen atoms which are capable of reacting with epoxy group.

As the second resin, any resin can be used as long as it can be dispersed in a sea of the first resin (polyester resin and/or polyol resin) to form islands and can contain a wax in the islands. Examples of the suitable second resins include a vinyl resin, a polyamide resin, rosin, a hydrogenated petroleum resin and a silicone resin. These resins may be used singly or in combination of two or more thereof.

It is preferred that the SP values of the first resin, second resin and wax have the following relationship:

$$SP_1 > SP_2 > SP_W$$

wherein $SP_1$, $SP_2$ and $SP_W$ stand for the SP values of the first resin, second resin and wax, respectively, for reasons that the wax can be contained in the islands rather than the sea. The SP value (solubility parameter δ) is defined by the following formula in the Hilderbrand-Scatchard solution theory:

$$\delta = (\Delta Ev/V)^{1/2}$$

wherein ΔEv represents the molar heat of evaporation, V represents the molar volume and ΔEv/V represents cohesive energy density. In the present specification, the SP value is calculated from the monomer composition using the method of Fedor according to the following formula:

$$SP \text{ value} = (\Sigma\Delta ei/\Sigma\Delta vi)^{1/2}$$

wherein Δei represents the atomic or atomic group heat of evaporation and Δvi represents the atomic or atomic group volume.

The second resin is preferably a mixture of

- a polyolefin resin (b1);
- a copolymer of a styrene compound (b2), an acryl compound (b3) and an acrylonitrile compound (b4); and
- a graft polymer of a polyolefin resin (b1) on which a styrene compound (b2), an acryl compound (b3) and an acrylonitrile compound (b4) have been grafted.

When such a mixture is used as the second resin, the islands of the second resin are efficiently dispersed in the sea of the first resin and, further, the wax can be predominantly contained in the islands. Therefore, the formation of the interface between the wax and the second resin and the interface between the islands and the sea is facilitated. In addition, the use of such a mixture as the second resin has a merit that the lowering of the gloss and transparency of a full color image obtained from the resulting toner is prevented because the difference in SP value between the first and second resins is small or because the amount of the wax can be reduced.

The polyolefin resin (b1) may be, for example, an olefin polymer such as polyethylene, polypropylene or an ethylene-propylene copolymer; or an oxidized olefin polymer such as oxidized polyethylene or oxidized polyporpylene. A polyethylene resin or a polypropylene resin is preferably used.

The styrene compound (b2) may be, for example, styrene, methylstyrene, trimethylstyrene, ethylstyrene, diethylstyrene, triethylstyrene, propylstyrene, butylstyrene, hexylstyrene, heptylstyrene, octylstyrene, fluorostyrene, chlorostyrene, bromostyrene, dibromostyrene, iodostyrene, nitrostyrene, acetylstyrene or methoxystyrene. Styrene is preferably used.

The an acryl compound (b3) may be, for example, methyl (meth)acrylate, ethyl (meth)acrylate, propyl (meth)acrylate, n-butyl (meth)acrylate, isobutyl (meth)acrylate, dodecyl (meth)acrylate, 2-ethylhexyl (meth)acrylate, lauryl (meth) acrylate, 2-hydroxyethyl (meth)acrylate, hydroxypropyl (meth)acrylate, 2-chloroethyl (meth)acrylate or (meth) acrylic acid.

The acrylonitrile compound (b4) may be, for example, (meth)acrylonitrile or cyanostyrene. Acrylonitrile is preferably used.

The styrene compound (b2), acryl compound (b3) and acrylonitrile compound (b4) of the copolymer and those of the graft copolymer are preferably the same, respectively.

It is preferred that the weight amount of the second resin is not smaller than that of the wax, since the wax can be contained in the islands of the second resin. The weight amount of the second resin is, however, preferably smaller than that of the first resin for reasons of suitable dispersion diameter of the islands, improved low temperature fixation properties and improved preservability. In the case of a color toner, the amount of the second resin is preferably 20% by weight or less based on the total weight of the first resin, the second resin and the wax for reasons of improved gloss and transparency.

It is preferred that the second resin have a glass transition point (Tg) higher than that of the first resin, since the preservability of the toner is not adversely affected even when the first resin has such a low Tg as to permit low temperature fixation. Even when the amount of the second resin is small so as to permit the low temperature fixation, the second resin can improve the preservability of the toner because a relatively large proportion of the second resin is present on outer surfaces of the toner. Preferably, Tg of the first resin is 50–80° C., more preferably 55–75° C., while the Tg of the second resin is preferably 50–90° C., more preferably 55–85° C. for reasons of satisfactory preservability and low temperature fixation. In the present specification, Tg is as measured by Rigaku THERMOFLEX Tg8110 (manufactured by Rigaku Denki Co., Ltd.) at a heating rate of 10° C./min.

It is preferred that the second resin be free of tetrahydrofuran insolubles for reasons of improved releasability. When the second resin is formed of a THF insoluble-free resin, exudation of the wax contained in the second resin can be facilitated can occur before the cohesive force of the molten toner is lowered during the fixation step.

It is also preferred that each of the first and second resins be free of tetrahydrofuran insolubles in the case of a full color toner for reasons of improved color tone. In a full color toner, toners of different colors are melted and mixed to develop a desire color. For facilitating the melting of the toner, THF insolubles in the first and second resins are desired not to be present. In the case of a black toner, however, it is not necessary that the first resin should be free of tetrahydrofuran insolubles.

In the present specification, measurement of THF insolubles is carried out as follows: About 50 g of THF is added to about 1 g of a resin or toner sample, and the mixture is allowed to stand at 20° C. for 24 hours. The mixture is then filtered through a filter paper Class 5C for quantitative measurement specified in the Japanese Industrial Standards (JIS P3801). The filter and insoluble matters on the filter are dried and weighed. The weight percentage of a THF-insolubles is calculated, using the following formula:

$$\text{THF-insolubles}(\%)=\{(C-B)/A\}\times 100$$

wherein A is the weight of the sample, B is the original weight of the filter paper and C is the weight of the filter paper and insoluble matters paper.

When the sample is a toner, the insoluble matters may include a colorant, a wax, etc. which are not derived from the binder resin. In such a case, a thermoanalysis is separately performed to measure such components.

In the case of a full color toner, it is preferred that the first resin have a softening point Tm of 100–140° C., more preferably 105–135° C., for reasons of dispersibility of the second resin in a sea of the first resin. The use of such a low softening point resin is also preferable in the case of a full color toner for reasons of improved transparency and gloss of the toner image.

In the case of a full color toner, it is preferred, for reasons of satisfactory gloss and transparency of the toner image and of anti-offset properties, that the first and second resins meet with the following relationship:

$$1 \geqq \log N_1 - \log N_2 \geqq -1$$

wherein $N_1$ is a melt viscosity of the first resin at a temperature between (Tm−5)° C. and (Tm+5)° C. where Tm is a softening point of the first resin and $N_2$ is a melt viscosity of said second resin at a temperature between (Tm−5)° C. and (Tm+5)° C. where Tm is as defined above. The softening point and the melting viscosity of the binder resin for use in the toner are measured using a commercially available flow tester of capillary type, "CFT-500", made by Shimadzu Corporation. A sample of the resin (1 $cm^3$) is placed in a cylinder of the tester, and the temperature is increased at a rate of 6° C./min. A pressure of 10 $kg/cm^2$ is applied to the resin sample so as to extrude the resin sample through a small orifice with a diameter of 0.5 mm in the die. The height of the sample resin in the cylinder decreases as the resin initiates to flow through the orifice. The softening point of the sample resin is a temperature corresponding to the midpoint between the height of the flow initiation point and the height of the flow termination point.

In the case of a full color toner, a fixation method using a belt is more advantageous than a heat roller-type fixation method because the former method is suited to lower the fixation temperature. However, from the standpoint of gloss and transparency of the color image, the belt-type fixation method which requires a lower contact pressure is less advantageous as compared with the heat roller fixation method. Since the toner of the present invention is designed to minimize a reduction of transparency and gloss of the image, a belt-type fixation method can be suitably used.

The toner of the present invention contains a colorant for a black toner or a full color toner in addition to the first resin, the second resin and the wax.

Examples of dyes and pigments used as the colorant include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Yellow Lake, Quinoline Yellow Lake, Anthracene Yellow BGL, isoindolinone yellow, red iron oxide, red lead, orange lead, cadmium red, cadmium mercury red, antimony orange, Permanet Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and the like. These dyes and pigments are employed alone or in combination. The colorant is generally used in an amount of 0.1 to 50 parts by weight per 100 parts by weight of the binder resin.

The toner of the present invention may additionally contain a charge controlling agent, if desired. Specific examples of the charge controlling agents include a metal complex salt of a mono azo dye, nitrohumic acid, nitrohumic acid salt, quaternary ammonia salt, imidazole metal complex and imidazole salt. Salicylic acid, naphthoic acid, a complex amino compound of a metal such as Co, Cr and Fe of dicarboxylic acid, an organic boron salt, a calyx arene compound or an organic pigment can be also used. In the case of a full color toner, it is preferable to select a transparent or white material so as not to deteriorate the color tone of the toner.

The amount of the charge controlling agent varies with the kind of binder resin, the presence or absence of optional additives, and the preparation method of the toner including the method of dispersing the composition of the toner. Generally, however, the amount of the charge controlling agent is 0.1 to 10 parts by weight, preferably 2 to 5 parts by weight, per 100 parts by weight of the binder resin. When the amount is at least 0.1 part by weight, the toner can be sufficiently charged and thus is fit for use in practical. When the amount is not more than 10 parts by weight, the chargeability of the toner is adequate so that suitable fluidity and image density can be ensured.

The toner of the present invention may include a magnetic material to be used as a magnetic toner. Examples of the magnetic materials include iron oxides such as ferrite, magnetite or maghematite, metals such as iron, cobalt or nickel, and alloys of such metal or metals with another metal. The magnetic materials may be employed alone or in combination. In the case of a full color toner, it is preferable to select a transparent or white material so as not to deteriorate the color tone of the toner.

In the present invention, fine particles of hydrophobic silica or titanium oxide are preferably used as an external additive to cover the toner particles. In addition, fine particles of hydrophobic alumina, fine particles of a resin, or fine particles of a lubricant such as an aliphatic metal salt or polyvinylidene fluoride may be also used. Especially, a toner having high transferability and high stability in charging characteristics to humidity can be obtained when hydrophobic silica and hydrophobic titanium oxide are used together as an external additive with the amount of hydrophobic silica smaller than that of the hydrophobic titanium oxide.

Examples of agents capable of imparting hydrophobicity include dimethyl dichlorosilane, trimehtylchlorosilane, methyl trichlorosilane, allyl dimethyl dichlorosilane, allyl phenyl dichlorosilane, benzyl dimethyl chlorosilane, bromomethyl dimethyl chlorosilane, α-chloroethyltrichlorosilane, p-chloroethyltrichlorosilane, chloromethyl dimethyl chlorosilane, chloromethyl trichlorosilane, p-chlorophenyltrichlorosilane, 3-chloropropyl trichlorosilane, 3-chloropropyl trimethoxysilane, vinyl triethoxysilane, vinyl methoxysilane, vinyl-tris(β-methoxyethoxy)silane, γ-methacryloxypropyltrimethoxysilane, vinyl triacetoxysilane, divinyl dichlorosilane, dimethyl vinyl chlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyl trimethoxy-silane, hexamethyl disilazane, hexaethyl disilazane, diethyl tetramethyl disilazane, hexaphenyl disilazane, and hexatolyl disilazane. In addition, titanate based coupling agent and aluminum based coupling agent can also be employed.

By mixing the toner particles with the external additive using a suitable mixer, the additive may coat the surfaces of the toner particles while being ground.

The toner according to the present invention can be used either as a two-component developer or as a one-component developer.

When employed as a two-component developer, the toner is used as a mixture with a carrier powder. Any conventionally-known carrier can be used for the purpose of the present invention. Examples of the suitable carriers include iron powder, ferrite powder, magnetite powder, nickel powder and glass beads, and these powders having a surface treated with a resin.

The toner of the present invention can be prepared by any conventionally-known method.

As a device for kneading ingredients of the toner, the following kneaders can be appropriately employed: a batch-type two-roll mixer, Banburry's mixer, a continuous two-roll extruder such as a KTK type two-axle extruder manufactured by Kobe Steel, Ltd., a TEM type two-axle extruder manufactured by Toshiba Machine Co., Ltd., a two-axle extruder made by KCK Co., Ltd., a PCM type two-axle extruder manufactured by Ikegai Tekko Co., Ltd., a KEX type two-axle extruder manufactured by Kurimoto, Ltd., and a continuous one-axle kneader such as KO-KNEADER manufactured by Buss AG.

The ingredients may be suitably blended using a Henschel mixer or the like before kneading. It is possible to use a processed colorant obtained by, for example, kneading a colorant with a small amount of a resin for the purpose of obtaining uniform dispersion of the colorant.

The thus obtained kneaded mixture is cooled and ground. The grinding may be performed by a combination of a coarse pulverization with a hammer mill, Rotoplex (a grinder manufactured by Hosokawa Micron Co., Ltd.) or the like and succeeding fine pulverization with a jet air pulverizer or a mechanical pulverizer. When necessary depending upon the particle size distribution of the obtained toner, the toner will be adjusted to have a desired particle size distribution by an air classifier or the like. The volume average particle size of the toner is preferably 4–10 μm for reasons of freedom of background stains or filming, improved fluidity and improved developing efficiency.

As a fixing device of the present invention, a heat roller-type fixing device or a belt thermal fixing device is generally employed. Especially, a belt thermal fixing device can easily accomplish fixation at a lower temperature. However, since the fixing pressure to smooth an image surface is lower in the in a belt thermal fixation device, the gloss or transparency of the image tends to be lowered as compared with a heat roller-type fixation. The toner of the present invention, however, can lower the decrease in gloss or transparency and thus can provide gloss and transparency required to a full color image even by belt-thermal fixation. Therefore, it is especially advantageous to use the toner according to the present invention in belt-type fixation.

An example of a belt thermal fixing device is shown in FIG. 1.

Designated as R1 is a fixing roller having a core of a metal, such as aluminum or iron, surrounded by an elastic material, such as a silicone rubber, and as R3 is a heating roller having a hollow core of a metal, such as aluminum, iron, copper or stainless and a heating source H provided in the hollow core. A low heat capacity fixing belt B is trained between the fixing roller R1 and the heating roller R3. The fixing belt B comprises a substrate made of nickel or polyimide and having a thickness of about 30–150 $\mu$m, and a releasing layer provided on the substrate and made of a silicone rubber or a fluororesin. The thickness of the releasing layer is generally 50–300 $\mu$m in the case of the silicone rubber substrate and 10–50 $\mu$m in the case of the fluororesin substrate. Designated as S is a temperature sensor for measuring the surface temperature of a portion of the fixing belt B which is in contact with the heating roller R3. Designated as R2 is a pressure roller having a metal core and an elastic material provided on the core. The pressure roller R2 presses the fixing roller R1 from below via the fixing belt B, whereby a nip part is formed between the fixing belt B and the pressure roller R2. Designated as R4 is an oil applying roller for applying oil such as silicone oil to the fixing belt. Designated as G is a guide for supporting a print sheet P, such as a paper, bearing unfixed toner image thereon.

The above constitution is merely one example. The fixing roller R1 and/or the roller R2 may be provided therein with a heating source.

Figure 2:
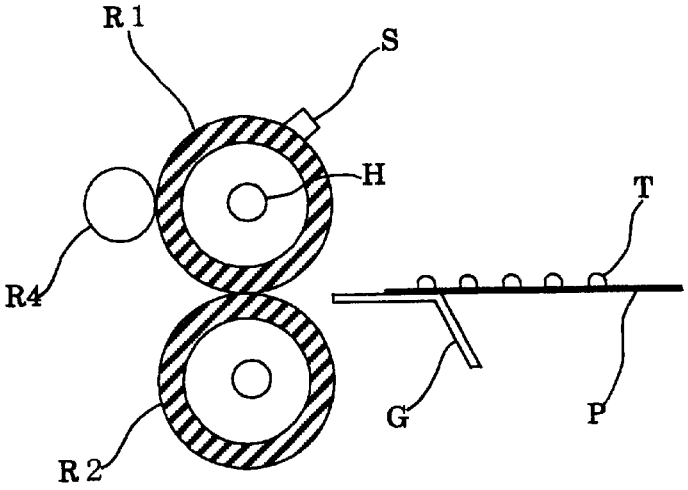
FIG. 2 is a cross-sectional view schematically illustrating a heat roll-type image fixing device.

An example of a heat roller-type fixing device is shown in FIG. 2.

Designated as R1 is a fixing roller having a core of a metal, such as aluminum, iron, copper or stainless steel, and an elastic material provided on the core and having a heating source H therein. Designated as R4 is an oil applying roller for applying an oil such as a silicon oil to the fixing roller R1. Designated as S is a temperature sensor for measuring the surface temperature of the fixing roller R1. Designated as R2 is a pressure roller comprising a core of a metal, such as aluminum or iron, and an elastic material provided on the core. The pressure roller R2 presses the fixing roller R1 from below, whereby a nip part is formed between the fixing roller R1 and the pressure roller R2. Designated as G is a guide for supporting a print sheet P, such as paper, bearing an unfixed toner image T thereon.

The above constitution is merely one example. An oil applying member including an oil tank may be provided in place of the oil applying roller R4, or the pressure roller R2 may be provided therein with a heating source.

The following examples will further illustrate the present invention. Parts are by weight.

In the Examples and Comparative Examples, evaluation methods and items for toner are as follows.

(1) Evaluation Items for Both Black Toner and Full Color Toner

Pulverizability:

Coarsely ground toner having an average particle size of not greater than 1 mm was pulverized using a pulverizer "Model IDS" manufactured by Nippon Pneumatic Mfg. Co., Ltd. under a given condition. The pulverizability of the toner is represented by the amount of the toner processed per hour.

| | |
|---|---|
| A: (Excellent) | 4 kg or more |
| B: (Good) | 3–4 kg |
| C: (Fair) | 1–3 kg |
| D: (No Good) | Less than 1 kg |
| E: (Poor) | 4 kg or more but a large amount of fine particles was generated |

Dispersion of Second Resin and Wax in Toner:

A toner particle was sliced into an ultra-thin piece having a thickness of about 100 nm and dyed with ruthenium tetroxide. A micrograph of the dyed thin piece was taken at a magnification of 10000 using a transmission electron microscope (TEM) and the number of islands of the second resin and the number of wax particles which were able to be observed on the micrograph were counted.

Dispersion of Islands of Second Resin:

A: (Excellent) Particles having a diameter of greater than 1.5 $\mu$m were not present B: (Good) Particles having a diameter of greater than 1.5 $\mu$m were present but particles having a diameter of greater than 2 $\mu$m were not present C: (Fair) Particles having a diameter of greater than 2 $\mu$m accounted for less than 1% by number D: (No good) Particles having a diameter of greater than 2 $\mu$m accounted for 1% or more by number.

Containment of Wax Particles in Islands of Second Resin:

A: (Excellent) All wax particles were contained in the islands of the second resin B: (Good) All wax particles having a diameter of 0.5 $\mu$m or greater were contained in the islands of the second resin, though smaller diameter wax particles were contained outside the islands C: (Fair) 95% or more but less than 100% by number of wax particles having a diameter of 0.5 $\mu$m or greater were contained in the islands of the second resin D: (No good) More than 5% by number of wax particles having a diameter of 0.5 $\mu$m or greater were not contained in the islands of the second resin Presence of Wax Particles on Outer Surfaces of Toner Particles:

A: (Excellent) Islands of the second resin containing wax particles having a diameter of 0.5 $\mu$m or greater were present but wax particles having a diameter of more than 2 $\mu$m are not present B: (Good) Islands of the second resin containing wax particles having a diameter of 0.5 $\mu$m or greater were not present islands containing wax particles having a diameter of 0.2 $\mu$m or greater were present. No wax particles having a diameter of 2 $\mu$m or greater are present.

C: (No good) Wax particles having a diameter of more than 2 $\mu$m present

D: (Poor) Islands of the second resin containing wax particles having a diameter of less than 0.2 $\mu$m were present Heat Resistant Preservability:

About 20 g of toner put in a glass vessel was tapped 50 times and tightly solidified. This was placed in a thermostatic chamber at 50° C. for 24 hours. Then, needle penetration degree of the solidified toner was measured.

| | |
|---|---|
| A: (Excellent) | Penetrated |
| B: (Good) | 25 mm or greater |
| C: (Fair) | 15–20 mm |
| D: (No good) | Less than 15 mm |

(2) Fixability of Black Toner

A copying machine (IMAGIO MF-200 manufactured by Ricoh Company, Ltd.) including a fixing device having a Teflon fixing roller was modified such that the fixing temperature may be varied. Using the copying machine and papers (Type 6200 manufactured by Ricoh Company, Ltd.), copying test was conducted. The fixing temperature was raised by 5° C. at a time from 125° C. and the temperature at which cold offset occurred and the temperature at which hot offset occurred were examined. When cold offset occurs at a temperature of less than 140° C., the toner can be said to permit low temperature fixation. When the temperature at which hot offset occurs is higher by at least 60° C. than the temperature at which cold offset occurs, the toner can be said to be developable in a wide temperature range without causing offset problems.

Durability of Black Toner

A continuous copying test on 50000 sheets was conducted at a fixing temperature of 140° C. using the same copying machine as that used in fixability test. Changes in image quality and in electrostatic charge amount (Q/M) of the developer after the test were examined.

A: (Excellent) The Q/M was hardly lowered and the image quality was excellent

B: (Good) The Q/M was lowered but the image quality was excellent

C: (Fair) The Q/M was lowered, and the image quality was changed but in a permissible level D: (No good) The image quality was deteriorated.

(4) Fixability of Full Color Toner

A copying machine (Preter 550 manufactured by Ricoh Company, Ltd.) was modified such that the fixing device may be exchanged to vary the fixing temperature. Using the copying machine, yellow, magenta, cyan and black solid images were printed on 70W papers (Type 6000 manufactured by Ricoh Company, Ltd.) As neutral color images, green, blue and red solid images were also produced. The copying machine was adjusted to develop 0.8±0.1 mg/cm$^2$ of toner at a single-color solid portion.

The following two fixing devices were used. Printing was conducted while the fixing temperature was raised by 5° C. at a time, from 125° C. in the case of the fixing device A and from 105° C. in the case of the fixing device B, and the temperature at which cold offset occurred and the temperature at which hot offset occurs were examined.

Fixing Device A:

A fixing device of the type shown in FIG. 1 was set at the following conditions:

Belt tension: 1.5 kg/piece

Belt speed: 200 mm/sec

Fixing nip width: 10 mm

Fixing roller:

Diameter: 38 mm

Surface material and hardness thereof: silicone foam having ASKAR-C hardness of about 30 degrees Pressure roller:

Diameter: 50 mm

Surface material and hardness thereof: PFR tube+silicone rubber having a thickness of 1 mm and ASKAR-C hardness of about 70 degrees Core diameter: 48 mm (iron, thickness: 1 mm)

Heating roller:

Diameter: 30 mm (aluminum, thickness: 2 mm)

Fixing belt:

Diameter: 60 mm

Substrate: polyimide having a thickness of about 50 μm

Releasing layer: silicone rubber having a thickness of 150 μm.

Surface roughness: Rz 4.1 μm

Width: 310 mm

Oil applying roller: removed

Fixing Device B:

A fixing device of the type shown in FIG. 2 was set at the following conditions:

Belt speed: 140 mm/sec

Fixing roller:

Diameter: 60 mm, a silicone rubber having a thickness of about 2 mm and coated with PFA in a thickness of 30 μm Core diameter: 56 mm (iron, thickness: 2 mm)

Surface roughness: Rz 4.5 μm

Pressure roller:

Diameter: 60 mm, a silicone rubber having a thickness of 1 mm and coated with PFA in a thickness of 30 μm Core diameter: 58 mm (iron, thickness: 1 mm)

Bearing pressure: 4.8 kgf/cm$^2$

Fixing nip width: 7 mm

Oil applying roller: removed

The temperature at which cold offset occurs should be not higher than 105° C. in the case of the fixing device A and not higher than 120° C. in the case of the fixing device B.

The temperature at which hot offset occurs should be higher by at least 60° C. than the temperature at which cold offset occurs.

Gloss:

Of the images whose fixability were examined, the gloss of blue, green and red solid images obtained at a fixing temperature of 140° C. in the case of the fixing device A and 150° C. in the case of the fixing device B were measured with a gloss meter manufactured by Nippon Denshoku kogyo Co., Ltd. with incident angle of 60°. The measurement was conducted at 3 points and the results were averaged. When the value is 10 or higher, the image is regarded as having satisfactory gloss.

Transparency:

The same images as produced in gloss test were produced on OHP sheets (Type PPC-DX manufactured by Ricoh Company, Ltd.) at half an image production linear speed of that used for the gloss test were produced. The transparencies of blue, green and red images were measured with a direct reading haze computer (HGM-2DP manufactured by Suga Tester Co., Ltd). The haze of the toner was obtained by subtracting the haze of the OHP sheet itself from the haze of the OHP sheet on which an image was produced. When the haze is 30% or lower, the image is regarded as having satisfactory transparency.

Durability:

A continuous printing test on 10000 sheets was conducted under the same condition under which the gloss test was conducted. After printing on 10000 sheets, changes in image quality and electrostatic charge amount (Q/M) of the developer with respect to the initial state were examined.

A: (Excellent) The Q/M was hardly lowered and the image quality was excellent

B: (Good) The Q/M was lowered but the image quality was excellent

C: (Fair) The Q/M was lowered, and the image quality was changed but in a permissible level D: (No good) The image Quality was deteriorated

EXAMPLE 1

| Toner Ingredients: | |
|---|---|
| First resin: polyester resin (tetrahydrofuran insolubles: 25% by weight, Tg: 62° C., Tm: 179° C., SP value: 10.6) | 38 parts |
| Polyol resin (tetrahydrofuran insolubles: none, Tg: 63° C., Tm: 115° C., SP value: 11.4) | 38 parts |
| Second resin: styrene/butyl acrylate/ methyl methacrylate copolymer (tetrahydrofuran insolubles: 1% by weight, Tg: 62° C., Tm: 132° C., SP value: 9.1) | 20 parts |
| Wax: ester wax (mp: 100° C., SP value: 8.5) | 4 parts |
| Charge controlling agent: metal containing azo dye | 1 part |
| Colorant: carbon black | 10 parts |

The above toner ingredients were fully mixed and agitated in a Henschel mixer and then kneaded in a two-axle extruder at 150–160° C. After having been cooled, the kneaded mixture was coarsely ground by a cutter mill and then finely pulverized by a pulverizer using jet air. This was then classified using an air classifier to obtain mother toner particles having an average diameter of 7±1 $\mu$m. Although the toner had a good pulverizability, fine particles were hardly generated and loss due to the classification was small. With 100 parts of the mother toner particles were mixed 0.2 part of hydrophobic silica and 0.4 part of titanium oxide in a Henschel mixer, thereby obtaining a toner. A sea-islands structure and presence of wax particles contained in the islands were observed on a TEM image of a thin piece of the toner. Also observed was presence of islands containing wax particles on outer surfaces of the toner particles.

3 Parts of the toner and 97 parts of a carrier having an average particle size of 50 $\mu$m were mixed and agitated in a tabler mixer to prepare a properly charged developer. The developer was supplied to the developing part of a modified copying machine (IMAGIO MF-550 manufactured by Ricoh Company, Ltd.) and the evaluations were conducted. The toner was fixed at a low temperature and the non-offset temperature range of the toner was sufficiently wide. The image obtained using this toner had no surface stains and nonuniformity in density. In the durability test, high quality images without surface stains and decrease in image density were obtained in all 50000 copies. The results of the evaluations are summarized in Table 1.

EXAMPLE 2

| Toner ingredients: | |
|---|---|
| First resin: polyester resin (tetrahydrofuran insolubles: 10% by weight, Tg: 62° C., Tm: 175° C., SP value: 10.6) | 43 parts |
| Second resin: the same one as in Example 1 | 42 parts |
| Wax: polyethylene wax (mp: 92° C., SP value: 8.0) | 15 parts |
| Charge controlling agent: metal containing azo dye | 1 part |
| Colorant: carbon black | 10 parts |

A toner was prepared from the above ingredients in the same manner as in Example 1 and the thus obtained toner was evaluated in the same manners as in Example 1. It was confirmed that the toner has no problem in its quality.

However, since the amount of the second resin and the amount of the wax were larger than those of Example 1, particles of wax contained in the islands of the second resin were larger in size than those of Example 1 and wax particles having relatively large dispersion diameter were present on outer surfaces of toner particles although the number thereof was not large. The resins used in this example had a Tg which was generally the same as that of the resins of Example 1 but the resulting toner was inferior in the low temperature fixability to the toner of Example 1. The reason is believed to be that the content of polyester resin which has a good effect on low temperature fixation was relatively decreased. Thus, when the content of the second resin is greater, low temperature fixation may not be accomplished. Also, despite the fact that most of the wax particles were contained in the islands of the second resin, wax particles having relatively large dispersion diameter were present on the outer surfaces of toner particles and caused deterioration in the image quality although the degree of the deterioration was too small to be significant. Thus, when the content of the wax is greater, satisfactory durability may not be obtained.

EXAMPLE 3

| Toner ingredients: | |
|---|---|
| First resin: polyester resin (tetrahydrofuran insolubles: 30% by weight, Tg: 60° C., Tm: 185° C., SP value: 10.7) | 38 parts |
| Polyol resin (the same one as in Example 1) | 38 parts |
| Second resin: mixture of 10 parts of (b1), 30 parts of (B2) and 60 parts of (B3) (tetrahydrofuran insolubles: none, Tg: 66° C., Tm: 134° C., SP value: 10.8) (b1): polyethylene and polypropylene (B2): copolymer of (b2), (b3) and (b4) (b2): styrene (b3): butyl acrylate and acrylic acid (b4): acrylonitrile (B3): graft polymer of (b1) on which (b2), (b3) and (b4) have been grafted | 20 parts |
| Wax: polyethylene wax (mp: 92° C., SP value: 8.0) | 4 parts |
| Charge controlling agent: metal compound of salicylic acid | 1.5 parts |
| Colorant: carbon black | 10 parts |

A toner was prepared from the above ingredients in the same manner as in Example 1 and the thus obtained toner was evaluated in the same manner as in Example 1.

The islands of the second resin were well dispersed in the toner particles as compared with Example 1 and most of the wax particles which were present on the outer surfaces of the toner particles were smaller in size than those of Example 1. Consequently, lowering of fluidity of toner and spent of wax to the surfaces of the carrier hardly occurred and high quality images were able to be obtained in all 50000 copies. This is believed to be an effect of constituting the second resin as above.

Also, since a resin having a Tg which is lower than those of conventional resins was employed, a toner capable of being fixed at a lower temperature was able to be obtained. Still, the toner was developable in a wide temperature range without causing offset problems. The reason is believed to be that the second resin is free of tetrahydrofuran insolubles. It is also believed that the good preservability of the toner is attributed to the fact that the second resin having a high Tg were present on the outer surfaces of the toner particles.

EXAMPLE 4

| Toner ingredients: | |
|---|---|
| First resin: polyester resin (tetrahydrofuran insolubles: 1% by weight, Tg: 63° C., Tm: 142° C., SP value: 10.8) | 84 parts |
| Second resin: a mixture 20 parts of (b1), 40 parts of (B2) and 40 parts of (B3) (tetrahydrofuran insolubles: none, Tg: 62° C., Tm: 122° C., SP value: 10.6) | 10 parts |
| (b1): polyethylene | |
| (B2): a copolymer of (b2), (b3) and (b4) | |
| (b2): styrene | |
| (b3): 2-ethylhexyl acrylate | |
| (b4): acrylonitrile | |
| (B3): graft polymer of (b1) on which (b2), (b3) and (b4) have been grafted | |
| The first and second resins met with the following relationship: | |
| $\log N_1 - \log N_2 > 1$ | |
| wherein $N_1$ is a melt viscosity of the first resin at a temperature between (Tm − 5) ° C. and (Tm + 5) ° C. | |
| where Tm is a softening point of the first resin and $N_2$ is a melt viscosity of the second resin at a temperature between (Tm − 5) ° C. and (Tm + 5) ° C. | |
| where Tm is as defined above. | |
| Wax: ester wax (mp: 100° C., SP value: 8.5) | 6 parts |
| Charge controlling agent: metal compound of salicylic acid | 1.5 parts |
| Colorants: | |
| Yellow: disazo type yellow pigment (C.I.Pigment Yellow 17) | 5 parts |
| Magenta: quinacridone type magenta pigment (C.I.Pigment Red 122 red) | 4 parts |
| Cyan: copper Phthalocyanine Blue (C.I.Pigment Blue 15) | 2 parts |
| Black: carbon black | 6 parts |

The ingredients of each toner were fully mixed and agitated in a Henschel mixer and then kneaded in a two-axle extruder at 100–110° C. The kneaded mixtures were coarsely ground by a cutter mill and then finely pulverized by a pulverizer using jet air. These were then classified using an air classifier to obtain colored mother toner particles having an average particle size of 8±1 μm. Although each of the toners had good pulverizability, fine particles were hardly generated and loss due to the classification was small. Consequently, colored mother toner particles having low fine powder content were able to be obtained.

With 100 parts of each of the colored mother toner particles were mixed 0.6 parts of hydrophobic silica and 0.6 parts of titanium oxide in a Henschel mixer to obtain yellow, magenta, cyan, and black toners. It was observed on TEM images of thin pieces of the toners that, in all the toners, islands of second resin were well dispersed in the toner particles and that wax particles were contained in the islands. It was also observed that, in all the toners, islands of second resin containing wax particles were present on the outer surfaces of the toner particles although wax particles were also present thereon. Although the first resin of this example contains tetrahydrofuran insolubles, the resulting toners were free of tetrahydrofuran insolubles.

5 Parts of each of the toners and 95 parts of a carrier having an average particle size of 50 μm were respectively mixed and agitated in a tabler mixer to obtain properly charged developers. The thus obtained developers were supplied to a modified copying machine (Preter 550 manufactured by Ricoh Company, Ltd.) and the evaluations were conducted. The fixing device B was employed as the fixing part. The images obtained using the toners had no surface stain and nonuniformity in density and all the colors were clearly and sharply developed although the gloss was low. Also, the transparency of images fixed on OHP sheets was low when the image production linear speed was a half of the original speed but satisfactory when the image production linear speed was reduced to one third of the original speed.

In the durability test, high quality images without surface stains and lowering of density were able to be obtained in all 10000 copies.

The results of the evaluations are summarized in Table 1.

EXAMPLE 5

| Toner ingredients: | |
|---|---|
| First resin: polyester resin (tetrahydrofuran insolubles: none, Tg: 61° C., Tm: 123° C., SP value: 11.2) | 76 parts |
| Second resin: styrene/methyl acrylate/methyl methacrylate copolymer (tetrahydrofuran insolubles: none, Tg: 59° C., Tm: 117° C., SP value: 9.2) | 20 parts |
| The first and second resins met with the following relationship: | |
| $1 \geqq \log N_1 - \log N_2 \geqq -1$ | |
| wherein $N_1$ is a melt viscosity of the first resin at a temperature between (Tm − 5) ° C. and (Tm + 5) ° C. | |
| where Tm is a softening point of the first resin and $N_2$ is a melt viscosity of the second resin at a temperature between (Tm − 5) ° C. and (Tm + 5) ° C. where Tm is as defined above. | |
| Wax: ester wax (mp: 83° C., SP value: 8.4) | 4 parts |
| Charge controlling agent: metal compound of salicylic acid | 2.5 parts |
| Colorants: the same as in Example 4 | |

Toners were prepared from above ingredients in the same manner as in Example 4 and the thus obtained toners were evaluated in the same manner as in Example 4.

Since the resins of this example are free of tetrahydrofuran insolubles and have a low Tg, dispersion effect by the shear force during kneading is small. Still, islands having generally the same dispersion diameter as that in Example 4 were formed. The reason is believed to be that the difference between the melt viscosities of the first and second resins is small as compared with that of Example 4. Although many of the wax particles had a dispersion diameter which was smaller than that of Example 4, there were many wax particles having a dispersion diameter of 0.5 μm or greater in the islands of the second resin and on the outer surfaces of the toner particles.

As a result, the toners have high fixability and cold offset did not occurred at 125° C. Also, the toner was developable in a wide temperature range without causing a hot offset problem. With these toners, sharp and clear full color images with high transparency and gloss were able to be obtained.

EXAMPLE 6

Using the fixing device A as the fixing part, the fixability of the toners obtained in Example 5 was evaluated.

The toners, which have been known to have high fixability, were able to permit fixation at a lower temperature with a belt thermal fixing device. The gloss and the transparency were slightly lowered as compared with Example 5 but satisfactory.

In this example, it is thought that when the content of the second resin is greater, the gloss and the transparency will be lowered. When transparency is not required, the toners can be used for full color images although the gloss is low, since colors can be developed when the toners were melted and mixed with each other. When transparency is required, it could be thought of melting the toners to a greater degree. However, since the poor transparency of this example is attributed not to elastic component of polyester as is the case with Example 4 but to incompatible interfaces, transparency cannot be obtained even if the image production linear speed is reduced. Thus, when gloss and transparency are required as a full color toner, the content of the second resin should be no more than that of this example. When the content is larger than that, it may be difficult to obtain high gloss and transparency.

EXAMPLE 7

Toners were prepared in the same manner as in Example 5 except that the second resin was changed to the same resin as used in Example 4 without changing the amount, that the amount of the wax was changed to 6 parts, and that the amount of the first resin was changed to 74 parts. The thus obtained toners were evaluated in the same manner as in Example 1 except that the fixing device A was employed as the fixing part.

The second resin was well dispersed in the particles of the toners. Although the amount of the wax was greater than that of Example 5, the dispersion diameter of the wax particles was smaller than that of Example 5 as a whole. Still, islands of the second resin containing wax particles having a diameter of 0.5 μm or greater were present on the outer surfaces of the toner particles.

Since the content of the wax was increased, the non-hot offset temperature range of the toner became wider. Also, since the SP value of the second resin is close to that of the first resin, gloss and transparency higher than those of Example 6 were able to be obtained. Since the Tg of the second resin of this example is higher than that of example 5, the preservability was improved.

EXAMPLE 8

| Toner ingredients: | |
|---|---|
| First resin: polyol resin<br>(tetrahydrofuran insolubles: none,<br>Tg: 62° C., Tm: 117° C., SP value: 11.4) | 90 parts |
| Second resin: the same mixture as one<br>in Example 3<br>The first and second resins meet with<br>the following relationship:<br>$1 \geqq \log N_1 - \log N_2 \geqq -1$<br>wherein $N_1$ is a melt viscosity of the<br>first resin at a temperature between<br>(Tm − 5) ° C. and (Tm + 5) ° C.<br>where Tm is a softening point of the first resin and<br>$N_2$ is a melt viscosity of the second resin<br>at a temperature between (Tm − 5) ° C. and<br>(Tm + 5) ° C. where Tm is as defined above. | 5 parts |
| Wax: the same one as in Example 4 | 5 parts |
| Charge controlling agent and colorants:<br>the same as in Example 4. | |

Toners were prepared from above ingredients in the same manner as in Example 4 and the thus obtained toners were evaluated in the same manner as in Example 1 except that the fixing device A was employed as the fixing part.

In this example, the second resin was not well dispersed by shear force as compared with Example 4. However, the difference between the melt viscosities of the first and the second resin is small, the second resin was well dispersed and wax particles having an especially large diameter were not observed on the outer surfaces of the toner particles. The fixability test revealed that the toners had low temperature fixability and the non-hot offset temperature range thereof was wide. Also, the image quality was not deteriorated in the durability test.

It was confirmed that when the second resin of this Example is used, the wax particles can be present in the islands of the second resin without having an excessively large dispersion diameter, namely, a toner of high quality can be obtained, even though the content of the second resin is the same as that of the wax.

EXAMPLE 9

| Toner ingredients: | |
|---|---|
| First resin: polyester resin<br>(tetrahydrofuran insolubles: none,<br>Tg: 60° C., Tm: 119° C., SP value: 10.6) | 85 parts |
| Second resin: a mixture of 10 parts of (b1),<br>60 parts of (B2) and 30 parts of (B3)<br>(tetrahydrofuran insolubles: none,<br>Tg: 65° C., Tm: 130° C., SP value: 10.4)<br>(b1): polyethylene<br>(B2): a copolymer of (b2), (b3) and (b4)<br>(b2): styrene<br>(b3): butyl acrylate<br>(b4): acrylonitrile<br>(B3): graft polymer of (b1) on which (b2),<br>(b3) and (b4) have been grafted<br>The first and second resins met<br>with the following relationship:<br>$1 \geqq \log N_1 - \log N_2 \geqq -1$<br>wherein $N_1$ is a melt viscosity of the<br>first resin at a temperature between<br>(Tm − 5) ° C. and (Tm + 5) ° C. | 8 parts |

-continued

| Toner ingredients: | |
|---|---|
| where Tm is a softening point of the first resin and $N_2$ is a melt viscosity of the second resin at a temperature between (Tm − 5) ° C. and (Tm + 5) ° C. where Tm is as defined above. | |
| Wax: ester wax (mp: 83° C., SP value: 8.4) | 4 parts |
| Charge controlling agent and colorants: the same as in Example 4. | |

Toner were prepared from the above ingredients in the same manner as in Example 4 and the thus obtained toners were evaluated in the same manner as in Example 1 except that the fixing device A was employed as the fixing part.

In this example, the dispersion of the second resin was excellent. The dispersion diameter of the wax particles contained in the islands of the second resin was not excessively small although the amount of the wax was small, and islands of the second resin containing wax particles having a diameter of 0.5 μm or greater were present on the outer surfaces of the toner particles. Moreover, the wax particles which were present on the outer surfaces of the toner particles did not have an especially large dispersion diameter. The diameter of the wax particles contained in the islands of the second resin was relatively large so that the toner was developable in a wide temperature range without causing offset problems. Still, there were no wax particles having an excessively large diameter and the durability was high.

COMPARATIVE EXAMPLE 1

A toner was prepared in the same manner as in Example 1 except that a copolymer of styrene, methyl acrylate and acrylonitrile (tetrahydrofuran insolubles: 2% by weight, Tg: 62° C., Tm: 135° C., SP value: 11.5) was used as the second resin. The thus obtained toner was evaluated in the same manners as in Example 1.

Although the dispersion of the second resin in the toner particles was good, the wax particles were dispersed without being contained in the islands of the second resin. Many of the wax particles have a dispersion diameter of over 2 μm, and wax particles having a large dispersion diameter were present on the outer surfaces of the toner particles. Namely, the toner did not have a structure aimed at by the present invention. Although the fixability was satisfactory, the durability was not satisfactory.

COMPARATIVE EXAMPLE 2

Toners were prepared in the same manner as in Example 8 except that the amount of the first resin was changed to 45 parts and that the amount of the second resin was changed to 50 parts. The thus obtained toners were evaluated in the same manner as in Example 1 except that the fixing device A was employed as the fixing part.

It was observed on TEM images of thin pieces of the toners that the dispersion diameter of the wax particles contained in the islands of the second resin was very small and that the dispersion of the second resin was poor and there existed a large number of particles having a dispersion diameter of 2 μm or greater. The fixability of the toner was poor. It is believed that the dispersion diameter of the wax particles were excessively small that the temperature at which offset occurred was low and that the gloss and the transparency were poor for its softening point because of the poor dispersion of the second resin.

In the durability test, surface stains occurred before 10000 copies were produced. When the particle size was measured after the test, a large amount of fine particles were remained.

COMPARATIVE EXAMPLE 3

| Toner ingredients: | |
|---|---|
| First resin: polyester resin (tetrahydrofuran insolubles: none, Tg: 64° C., Tm: 120° C., Sp value: 10.6) | 92 parts |
| Second resin: graft polymer of polyethylene on which styrene and butyl acrylate have been grafted (tetrahydrofuran insolubles: none, Tg: 64° C., Tm: 105° C., SP value: 9.4) | 4 parts |
| The first and second resins met with the following relationship: $1 \geqq \log N_1 - \log N_2 \geqq -1$ wherein $N_1$ is a melt viscosity of the first resin at a temperature between (Tm − 5) ° C. and (Tm + 5) ° C. where Tm is a softening point of the first resin and $N_2$ is a melt viscosity of the second resin at a temperature between (Tm − 5) ° C. and (Tm + 5) ° C. where Tm is as defined above. | |
| Wax: polyethylene wax (mp: 92° C., SP value: 8.0) | 4 parts |
| Charge controlling agent: metal compound of salicylic acid | 1.5 parts |
| Colorants: the same as in Example 4 | |

Toners were prepared from the above ingredients in the same manner as in Example 4 and the thus obtained toners were evaluated in the same manner as in Example 1 except that the fixing device A was employed as the fixing part. The toner had poor pulverizibility as compared with the toners of other Examples and Comparative examples. Also, it was observed on TEM images of thin pieces of the toners that the wax particles were present in the first resin in a very small dispersion diameter but no islands of the second resin existed.

Although the fixed images obtained using these toners have high gloss and transparency, the non-offset temperature range was narrow.

The entire disclosure of Japanese Patent Application No. 2000-361,593 filed on Nov. 28, 2000, including the specification, claims and drawing is hereby incorporated by reference herein.

TABLE 1

| | Example | | | | | | | | | Comp. Example | | |
|---|---|---|---|---|---|---|---|---|---|---|---|---|
| | 1 | 2 | 3 | 4 | 5 | 6 | 7 | 8 | 9 | 1 | 2 | 3 |
| Pulverizability | A | A | A | A | | A | A | A | A | B | A | D |
| Heat resistant preservability | A | C | A | B | | C | B | A | A | C | A | A |

TABLE 1-continued

| | Example | | | | | | | | | Comp. Example | | |
|---|---|---|---|---|---|---|---|---|---|---|---|---|
| | 1 | 2 | 3 | 4 | 5 | 6 | 7 | 8 | 9 | 1 | 2 | 3 |
| Dispersion of islands of second resin | B | B | A | B | | B | A | A | A | D | D | X |
| Containment of wax particles in islands of second resin | A | A | A | A | | A | A | A | A | D | A | X |
| Presence of wax particles on outer surfaces of toner particles | B | A | B | B | | B | A | A | A | C | C | C |
| Temperature at which cold offset occurred | 130 | 135 | 125> | 130 | 125> | 100> | 100> | 100 | 100 | 130 | 120 | 100 |
| Temperature at which hot offset occurred | 200< | 200< | 200< | 200< | 180 | 165 | 175 | 180 | 185 | 200< | 160 | 150 |
| Gloss | — | — | — | 8 | 20 | 12 | 22 | 13 | 16 | — | 7 | 27 |
| Haze | — | — | — | 40 (28) | 24 | 27 | 18 | 22 | 19 | — | 42 | 16 |
| Durability | A | C | A | B | B | B | A | A | A | D | D | A |

X: The islands of the second resin were not able to be observed.

What is claimed is:

1. A toner for developing electrostatic latent images, comprising:

a matrix of a first resin selected from the group consisting of polyester resins, polyol resins and mixtures thereof, a plurality of domains of a second resin dispersed in said matrix and containing a wax, wherein said second resin is a mixture of a polyolefin resin, a copolymer of a styrene compound/an acryl compound/an acrylonitrile compound and a graft polymer of a polyolefin resin on which a styrene compound, an acryl compound and an acrylonitrile compound have been grafted, wherein the amount of said wax is 2–15% by weight based on the weight of the toner, wherein said matrix is substantially free of domains of said second resin having a diameter greater than 2.0 $\mu$m, wherein at least one of said domains is present as a surface domain on the outer surface of said toner, wherein said surface domain comprises said wax in the form of wax particles present inside said surface domain, and wherein at least one of said wax particles has a diameter of 0.2 $\mu$m or greater.

2. A toner as claimed in claim 1, wherein said first resin has an SP value which is greater than that of said second resin, and wherein the SP value of said second resin is greater than that of said wax.

3. A toner as claimed in claim 1, wherein said first resin is present in a weight amount greater than that of said second resin and wherein the weight amount of said second resin is not smaller than that of said wax.

4. A toner as claimed in claim 1, wherein said first and second resins are substantially free of tetrahydrofuran insolubles.

5. A toner as claimed in claim 1, wherein said second resin is present in an amount of 20% by weight or less and wherein the weight amount of said wax is not greater than that of said second resin.

6. A toner as claimed in claim 1, wherein said first resin has a glass transition point lower than that of said second resin.

7. A method of forming a toner image on an image receiving sheet, comprising developing an electrostatic latent image on a photoconductor with a toner according to claim 1, transferring said developed toner image to the image receiving sheet, and fixing the transferred image on the image receiving sheet by contacting the image receiving sheet with a fixing belt.

8. A toner for developing electrostatic latent images, comprising:

a matrix of a first resin selected from the group consisting of polyester resins, polyol resins and mixtures thereof, a plurality of domains of a second resin dispersed in said matrix and containing a wax, wherein the amount of said wax is 2–15% by weight based on the weight of the toner, wherein said matrix is substantially free of domains of said second resin having a diameter greater than 2.0 $\mu$m, wherein at least one of said domains is present as a surface domain on the outer surface of said toner, wherein said surface domain comprises said wax in the form of wax particles present inside said surface domain, and wherein at least one of said wax particles has a diameter of 0.2 $\mu$m or greater;

wherein said first and second resins meet with the following relationship:

$$1 \geqq \log N_1 - \log N_2 \geqq -1$$

wherein $N_1$ is a melt viscosity of said first resin at a temperature between (Tm−5)° C. and (Tm+5)° C. where $N_2$ is a melt viscosity of said second resin at a temperature between (Tm−5)° C. and (Tm+5)° C., and where Tm is the softening point of said first resin.

9. A toner as claimed in claim 8, wherein said second resin is a mixture of a polyolefin resin, a copolymer of a styrene compound/an acryl compound/an acrylonitrile compound and a graft polymer of a polyolefin resin on which a styrene compound, an acryl compound and an acrylonitrile compound have been grafted.

10. A toner as claimed in claim 8, wherein said first resin is present in a weight amount greater than that of said second resin and wherein the weight amount of said second resin is not smaller than that of said wax.

11. A toner as claimed in claim 8, wherein said first and second resins are substantially free of tetrahydrofuran insolubles.

12. A toner as claimed in claim 8, wherein said second resin is present in an amount of 20% by weight or less and wherein the weight amount of said wax is not greater than that of said second resin.

13. A toner as claimed in claim 8, wherein said first resin has a glass transition point lower than that of said second resin.

14. A method of forming a toner image on an image receiving sheet, comprising developing an electrostatic latent image on a photoconductor with a toner according to claim 8, transferring said developed toner image to the image receiving sheet, and fixing the transferred image on the image receiving sheet by contacting the image receiving sheet with a fixing belt.

* * * * *